US009907719B2

(12) United States Patent
Stiff

(10) Patent No.: US 9,907,719 B2
(45) Date of Patent: Mar. 6, 2018

(54) AIR FLUIDIZED MATTRESS

(71) Applicant: The United Mattress, LLC, Brentwood, TN (US)

(72) Inventor: James Stiff, Lewisburg, TN (US)

(73) Assignee: The United Mattress, LLC, Brentwood, TN (US)

( * ) Notice: Subject to any disclaimer, the term of this patent is extended or adjusted under 35 U.S.C. 154(b) by 646 days.

(21) Appl. No.: 14/334,483

(22) Filed: Jul. 17, 2014

(65) Prior Publication Data

US 2017/0035636 A1 Feb. 9, 2017

(51) Int. Cl.

| | |
|---|---|
| ***A61G 7/057*** | (2006.01) |
| ***A47C 27/08*** | (2006.01) |
| ***A47C 27/10*** | (2006.01) |
| ***A47C 27/18*** | (2006.01) |

(52) U.S. Cl.

CPC ..... *A61G 7/05776* (2013.01); *A47C 27/081* (2013.01); *A47C 27/10* (2013.01); *A47C 27/18* (2013.01); *A61G 7/05769* (2013.01)

(58) Field of Classification Search

CPC ..... A47C 27/08; A47C 27/081; A47C 27/082; A47C 27/083; A47C 27/10; A47C 27/14; A47C 27/148; A47C 27/15; A47C 27/18; A47C 21/042; A47C 21/044; A47C 21/046; A47C 27/002; A47C 27/007; A61G 7/05769; A61G 7/05776

USPC ..... 5/706, 710, 713, 714, 644, 654, 655.3, 5/727, 728, 925, 926, 737, 738, 724, 5/652.1

See application file for complete search history.

(56) References Cited

U.S. PATENT DOCUMENTS 3,867,732 A * 2/1975 Morrell ..... A47C 4/54 297/284.3
4,186,734 A * 2/1980 Stratton ..... A61H 9/0078 5/655.3

(Continued)

OTHER PUBLICATIONS

American Medical Equipment, https://www.amemedbeds.com/Itc40.html (web site), Hot Spot LTC40, Advanced Wound Therapy Now Made Affordable for Every Bed, Jul. 23, 2015, three pages, Copyright 2012.

(Continued)

*Primary Examiner* — Robert G Santos

(74) *Attorney, Agent, or Firm* — Waller Lansden Dortch & Davis, LLP; Blake M. Bernard

(57) ABSTRACT

A mattress apparatus including a foam layer, an inflatable air cushion superposed with the foam layer, a first pneumatic line in fluid communication with the air cushion, and a non-shearing layer covering at least a portion of the air cushion. The air cushion can be inflated to support a patient such that the air cushion contours the patient's body and disperse pressure portions over a larger area, thereby helping eliminate pressure points which can cause or worsen skin wounds. The non-shearing layer can help prevent further tearing or pulling of the skin as a patient moves on the mattress. The foam layer can comprise viscoelastic polyurethane. The apparatus can include a removable cover at least partially surrounding the foam layer, inflatable air cushion, pneumatic first line, and non-shearing layer. An air passage can be defined through the removable cover.

17 Claims, 5 Drawing Sheets

(56) References Cited

U.S. PATENT DOCUMENTS 4,686,722 A * 8/1987 Swart ..... A61G 7/05769 5/713
5,029,939 A * 7/1991 Smith ..... A61G 7/05776 297/284.1
5,111,544 A * 5/1992 Graebe ..... A47C 7/021 5/485
6,212,718 B1 * 4/2001 Stolpmann ..... A61G 7/05776 285/914
6,516,483 B1 * 2/2003 VanSteenburg .... A61G 7/05715 5/727
6,701,558 B2 * 3/2004 VanSteenburg .... A61G 7/05715 5/713
7,434,283 B2 * 10/2008 Wilkinson ..... A47C 27/084 5/710
7,469,432 B2 * 12/2008 Chambers ..... A47C 21/044 5/423
7,712,164 B2 * 5/2010 Chambers ..... A47C 21/044 5/423
2003/0131419 A1 * 7/2003 VanSteenburg .... A61G 7/05715 5/737
2005/0125905 A1 * 6/2005 Wilkinson ..... A47C 27/082 5/713
2005/0151410 A1 * 7/2005 Sprouse, II ..... A47C 7/14 297/452.41
2005/0177952 A1 * 8/2005 Wilkinson ..... A47C 27/084 5/713
2006/0080778 A1 * 4/2006 Chambers ..... A47C 21/044 5/652.2
2009/0106907 A1 * 4/2009 Chambers ..... A47C 21/044 5/714
2015/0113735 A1 * 4/2015 Anderson ..... A47C 7/021 5/654
2017/0035636 A1 * 2/2017 Stiff ..... A61G 7/05776

OTHER PUBLICATIONS

ROHO, Inc., https://roho.com/category/products/therapeutic-mattresses/ (web site), Mattress Support Surfaces, Jul. 23, 2015 (attached pdf, 40 pages, of various webpages and brochures from the website detailing several relevant products, including a price list dated May 1, 2014 showing the products on sale as of that date), Copyrights ranging from 2009-2014.

The ROHO Group, ROHO Prodigy, Medical Mattress Overlay, Oct. 17, 2014, 2 pages, www.therohogroup.com/products/medical%20matresses/prodigy_matress_overlay.jsp.

* cited by examiner

AIR FLUIDIZED MATTRESS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: None

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to mattresses for medical patients with skin wounds.

More particularly, this invention pertains to mattresses for patients who are suffering from bed sores or pressure ulcers which can be a result of an extended stay in a hospital or medical facility. Traditional beds can produce pressure points on the body which over time can produce sores or wounds on the skin of the patient, which can be uncomfortable or painful. Additionally, patients suffering from skin trauma such as cuts, scraps, burns, bruises, or other skin injuries can experience pain from pressure points produced by traditional beds. The pressure points produced by traditional beds on the skin can irritate or exacerbate the affected area.

Additionally, movement of the patient on many traditional beds can cause additional skin tearing. Friction forces produced between the bed and the patient's skin during movement of the patient can pull the patient's skin causing tearing or additional trauma to the affected area.

What is needed, then, are improvements in mattresses for relieving pressure points on a person's body.

BRIEF SUMMARY OF THE INVENTION

One aspect of the present invention is a mattress apparatus including a foam layer. An inflatable air cushion can be superposed with the foam layer. A first pneumatic line can be in fluid communication with the air cushion. A non-shearing layer can cover at least a portion of the air cushion. The air cushion can be inflated in order to provide support for a patient lying or sitting on the mattress such that the air cushion contours the patient's body. Pressure against the patient's body can be dispersed to a larger area, which can help prevent or lower pressure points on the patient's body. The prevention or lowering of pressure points on the body can help prevent, alleviate, or heal bed sores, pressure ulcers, and other skin traumas such as burns or cuts. In some embodiments, the foam layer can include a viscoelastic polyurethane foam or "memory foam." The viscoelastic polyurethane foam can help additionally contour a patient's body to further disperse pressure and help relieve and prevent pressure points against the patient's body. The non-shear layer can help prevent additional tearing or pulling of a patient's skin when the patient moves on the mattress.

In some embodiments the apparatus can include a removable cover which can at least partially enclose the foam layer, the air cushion, the first pneumatic line, and the non-shear layer. An air passage can be defined through the removable cover such that air can circulate through the air mattress which can help keep the foam layer and air cushion dry as well as keeping the patient cool as heat built up in the mattress can be passed to the air passing through the mattress.

In another aspect of the present invention, a mattress apparatus includes a foam layer. An inflatable air cushion can be positioned on top of the foam layer. The air cushion can have a head portion and a foot portion. A first pneumatic line can be in fluid communication with the head portion of the air cushion, and a second pneumatic line can be in fluid communication with the foot portion of the air cushion. In some embodiments, the head and foot portions can be inflated independently such that the amount of air in each portion can be adjusted to vary the pressure applied to different areas of the body. In some embodiments, the air cushion can include a middle portion between the head portion and the foot portion, and the apparatus can include a third pneumatic line in fluid communication with the middle portion of the air cushion.

DETAILED DESCRIPTION OF THE INVENTION

Figure 1:
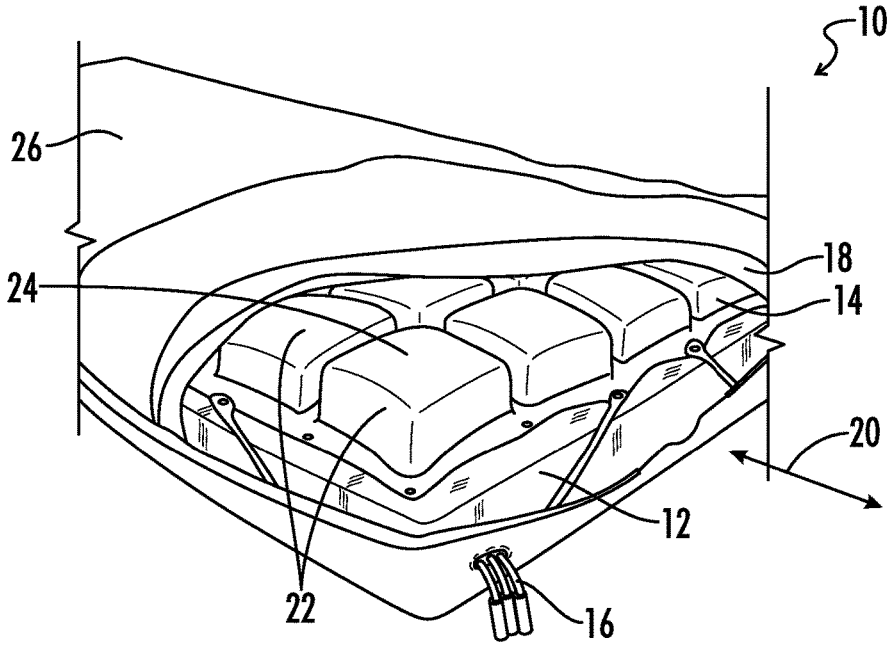
FIG. 1 is a side perspective view of an embodiment of a mattress apparatus of the present invention with a removable cover partially removed.

While the making and using of various embodiments of the present invention are discussed in detail below, it should be appreciated that the present invention provides many applicable inventive concepts that is embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The term "lateral" denotes a side to side direction when facing the "front" of an object.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Referring now to the figures, FIG. 1 shows a perspective view of an embodiment of a mattress apparatus 10 of the present invention. The apparatus 10 can include a foam layer 12. An inflatable air cushion 14 can be superposed with the foam layer 12 such that the air cushion 14 and the foam layer 12 are positioned one on top of the other. In one embodiment, as seen in FIG. 1, the air cushion 12 is positioned on top of the foam layer 12. A first pneumatic line 16 can be in fluid communication with the air cushion 14. In FIG. 1, the point at which the first pneumatic line 16 is communicated with the air cushion 14 is hidden beneath the air cushion. A non-shearing layer 18 or low friction layer can at least partially cover the air cushion 14. In some embodiments, the non-shearing layer 18 can cover substantially all of the air cushion 14. In still other embodiments, the non-shearing layer 18 can cover or enclose substantially all of the air cushion 14 and the foam layer 12.

The air cushion 14 can be inflated by forcing an air supply through the pneumatic line 16 and into the air cushion 14. Inflation of the air cushion 14 can provide support for a patient lying or sitting on the apparatus 10. The amount of air in the air cushion 14 can be adjusted via the pneumatic line 16 in order to increase or decrease the amount of pressure in the air cushion 14, which can increase or decrease the amount of air pressure exerted at a given point on the patient's body. The amount of air in the air cushion 14 can be adjusted such that when the patient is positioned on the air cushion 14, the air cushion 14 can deform to contour the patient's body and forces from the air cushion 14 can be spread across a larger area of the body, which can help eliminate or lower pressure points along the body. Pressure points acting on the same spot of a patient's body for an extended period of time can cause or worsen skin traumas such as bed sores or pressure ulcers. A reduction of pressure points on a patient's body can also be beneficial and helpful to ease the pain for patients who have a wide variety of skin traumas such as, but not limited to, burns, cuts, scrapes, bruises, rashes, etc.

As the patient is positioned on the apparatus 10, the foam layer 12 can similarly deform to further contour the patient's body, which can further disperse the forces acting on the body to a larger area and help further decrease or eliminate pressure points acting on the body. In some embodiments, the foam layer 12 can include viscoelastic polyurethane, commonly known as "memory foam." Viscoelastic polyurethane foam 12 is crafted with an open cell structure in which each foam cell has holes containing air. As the cells are compressed, the air in the affected cells spreads to neighboring cells, thus evenly distributing the air pressure in the foam 12 as well as the weight positioned on the foam, in this case the patient. As such, the viscoelastic polyurethane foam 12 can continually mold itself to the patient's body to effectively contour the patient and evenly distribute the patient's weight. Viscoelastic polyurethane foam 12 is also heat sensitive, in that the cells are softer in warmer temperatures. Thus, when the foam 12 makes contact with a warm temperature such as the patient's skin, the foam softens at the points where the body is increasing the temperature of the foam 12. The foam 12 molding itself to the patient's body can greatly decrease pressure points along the body. While some embodiments include viscoelastic polyurethane foam, the foam layer 12 can be any suitable foam which can help contour the patient's body. In some embodiments, the foam layer 12 can have a thickness between about 2 inches and about 20 inches. In other embodiments, the foam layer 12 can have a thickness greater than about 4 inches.

The non-shearing layer 18 can help prevent further skin tearing when a patient is positioned or moved on the apparatus 10. The non-shearing layer can be made from a low friction material such as nylon, Parafricta®, or other fabrics having a low coefficient of friction. The non-shearing layer 18 can help prevent friction between the mattress apparatus 10 and the patient's skin, which can help prevent further skin tearing or pulling which can be painful and can further damage the skin.

In some embodiments, the air cushion can include a plurality of air cells 22. The air cells 22 can be configured to transfer air pressure between each other such that the air cushion 14 can more easily deform and contour the patient's body. The air cells 22 can have generally rounded tops when inflated which can help contour the generally rounded shape of a patient's back or other body parts. The air cells 22 additionally can have space between individual cells, which can allow air to pass between the cells to keep the air cushion 14 cool and dry, as well as help keep the patient cool and comfortable.

Figure 2:
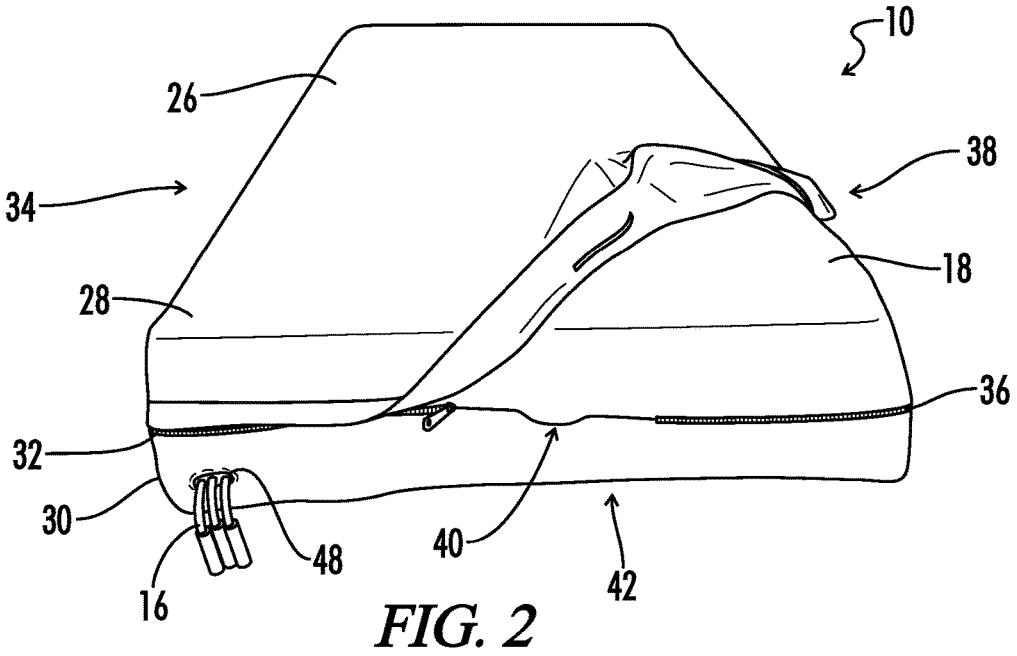
FIG. 2 is a front perspective view of the apparatus of FIG. 1 with the removable cover partially removed.

As can be seen in FIG. 1 and FIG. 2, in some embodiments, the apparatus 10 can include a removable cover 26. The removable cover 26 can at least partially enclose the foam layer 12, the air cushion 14, the first pneumatic line 16, and the non-shearing layer 18. The removable cover 26 in some embodiments can have a top portion 28 and a bottom portion 30 which can be removably connected together to enclose the components of the apparatus 10. In some embodiments the top portion 28 and the bottom portion 30 can be removably connected together using a first zipper 32 on a first side 34 of the removable cover 26, and a second zipper 36 on a second side 38 of the removable cover 26. The removable cover 26 can include any suitable fasteners for removably connecting the top portion 28 and the bottom portion 30 of the removable cover 26, including but not limited to, buttons, hook and loop assemblies, clasps, adhesives, etc. The first and second zippers 32 and 36 can be configured such that when the zippers are fully zipped, a first opening 40 can be formed between the two ends of the zippers on a foot end 42 of the removable cover 26.

Figure 3:
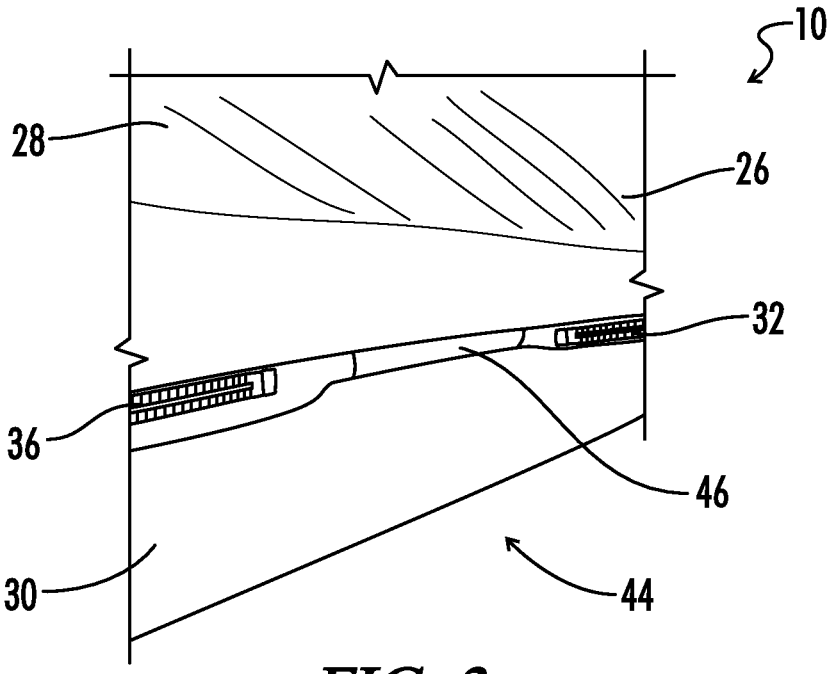
FIG. 3 is a detailed view of a head end of the apparatus of FIG. 1.
Figure 4:
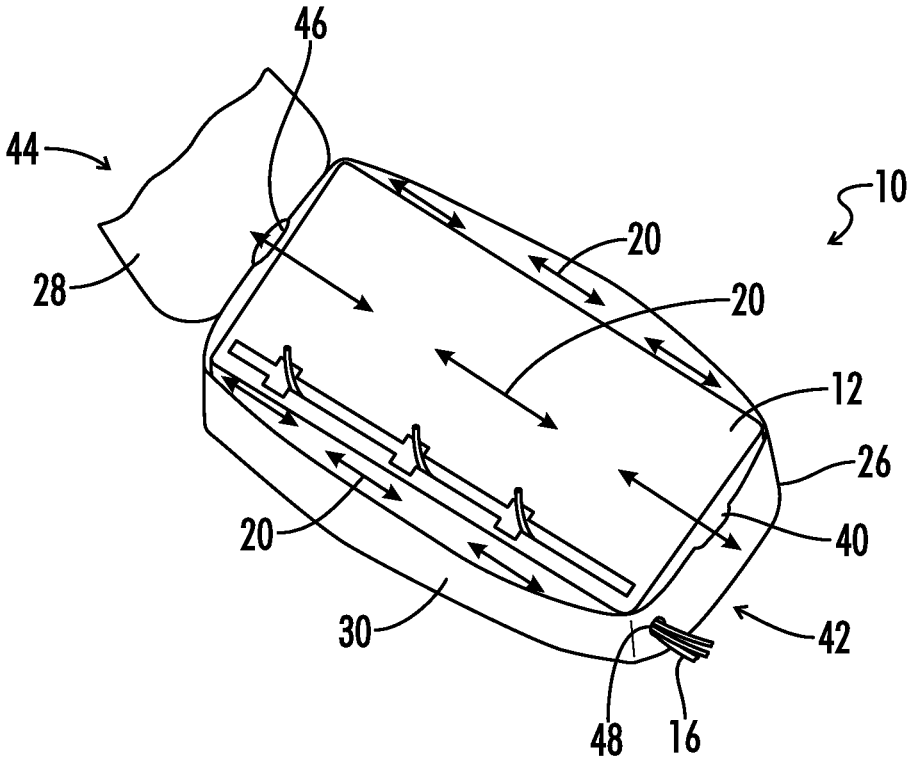
FIG. 4 is a side perspective view of the apparatus of FIG. 1 with the top of the removable cover completely removed and exemplary air passages passing through the mattress.

A view of the head end 44 of the removable cover 26 can be seen in FIG. 3. The beginning of the zipper tracks can also be configured to form a second opening 46 in the head end 44 of the removable cover 26. The first and second openings 40 and 46 can define an air passage 20 through the mattress apparatus 10. In FIG. 4, the top portion 28 has been pulled back from the bottom portion 30 to better show exemplary air passages 20 through the apparatus 10. The air cushion 14 and non-shear layer have also been removed to better show exemplary air passages 20 through the mattress apparatus 10.

In some instances, air can pass through the second opening 46 in the head end 44 of the cover 26, pass through the mattress, and exit out of the first opening 40 in the foot end 42 of the removable cover 26. In other instances, air can flow in the opposite direction. Air passing through the mattress apparatus 10 can help keep the apparatus 10 components free from moisture which can help prevent or heal sores as added moisture can worsen sores. Additionally air passing through the apparatus 10 can help disperse heat which can be built up in the mattress 10 from the patient's body heat, which can help keep the apparatus 10 and the patient cool. The air can pass over the foam layer 12, the air cushion 14, and the non-shearing layer 18.

As the patient gets on and off of the apparatus 10, or moves on the apparatus 10, air contained in the viscoelastic polyurethane foam 12 can be forced in and out of the individual cells of the foam layer 12. Some of the air can exit out of the foam and into the space generally defined by the removable cover 26. Having openings in the removable cover 26 as opposed to having a completely enclosed fixed volume cover can allow the air entering and exiting the foam layer 12 to effectively circulate through the apparatus 10. A fixed volume cover would trap the air and effectively prevent circulation of the air as it enters and exits the foam layer 12. Circulation of this air source can further keep the mattress dry and cool.

In some embodiments of the apparatus 10, the cover 26 can be equipped with a number of check valves, such that when a patient gets on or off the apparatus 10, air can be forced through the check valve and prevented from reentering the apparatus 10. As such, air can be systematically forced out of the apparatus when the patient gets onto the apparatus 10, and air can be forced into the apparatus 10 when the patient subsequently gets off of the apparatus 10. As such, forced circulation can occur within the apparatus 10, and specifically within the removable cover 26.

The top portion 28 of the removable cover 26 can be loosely fit over the non-shearing layer 18 such that when a patient moves on the top portion 28 of the cover 26, the top portion 28 is free to slide with little friction on the non-sheering layer 18, which can help prevent further tearing of skin on the patient's body during movement on the apparatus 10. In some embodiments, the top portion 28 of the removable cover 26 can be removed during use such that the patient can be positioned directly on the non-shearing layer 18. In other embodiments, the top portion 28 of the removable cover 26 can additionally include a non-shearing material such as nylon, Parafricta®, or other material having a low coefficient of friction, such that the removable cover 26 can act as both a cover for the mattress apparatus 10 as well as a non-shearing layer to help prevent additional skin tearing as the patient moves on the apparatus 10.

In some embodiments, the top portion 28 of the removable cover 26 can be configured to be water or fluid proof. The top portion 18 can be treated with a polyurethane film such that sweat, bodily fluids, or other liquids can be prevented from seeping through the top portion 28 of the removable cover 26 and contacting the foam layer 12, the air cushion 14, or the non-shear layer 18. Keeping the other component of the apparatus 10 dry can help prevent moisture build up and generally prolong the life of the apparatus 10.

In some embodiments, the bottom portion 30 of the removable cover 26 can include a gripping surface which can help prevent the mattress 10 from sliding or moving while a patient is getting onto, getting off of, or generally moving on the mattress 10. The bottom portion 30 in some embodiments can include a beaded PVC resin which can be operable to prevent the mattress from sliding on a tile floor or other finished or slick surface. Preventing the mattress 10 from moving during operation can help increase the safety of the apparatus 10.

Figure 5:
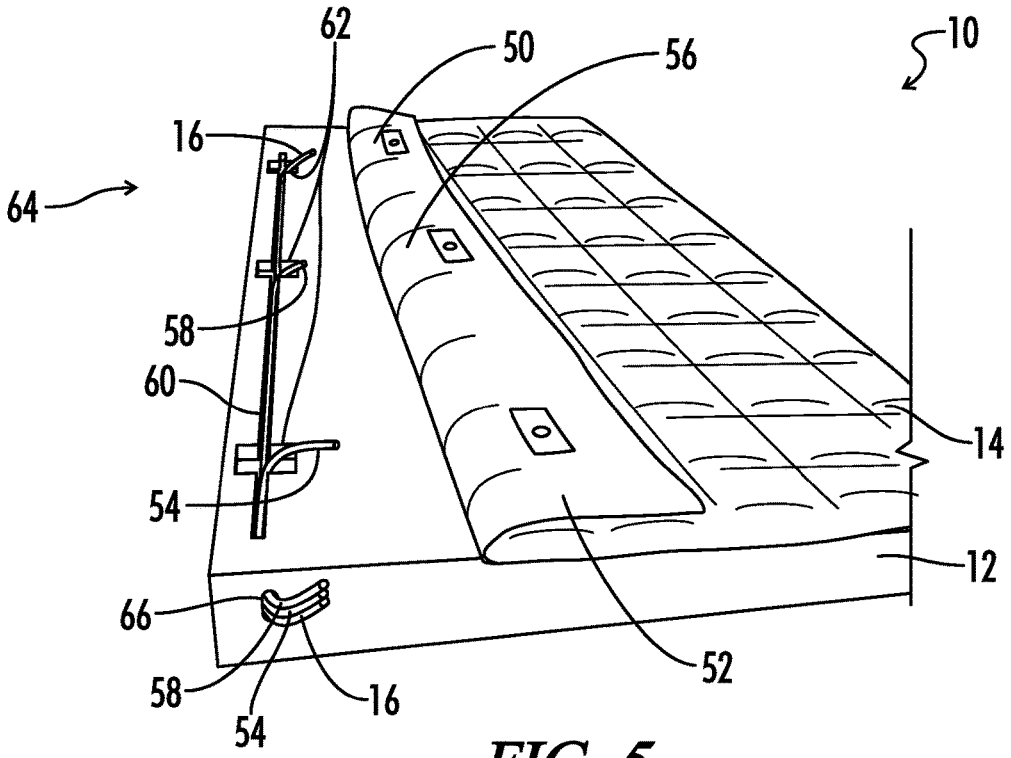
FIG. 5 is a disassembled view of the apparatus of FIG. 1 showing an exemplary foam layer and air cushion.

A disassembled view of the apparatus 10 is shown in FIG. 5 with the cover 26 and the non-shearing layer 18 removed, and the air cushion 14 in a deflated configuration. Having the air cushion 14 in a deflated position can allow for easier or more convenient and efficient storage as the size of the apparatus 10 can be substantially reduced.

In some embodiments, the air cushion 14 can further include a head portion 50 and a foot portion 52. The apparatus 10 can also include a second pneumatic line 54. The first pneumatic line 16 can be in fluid communication with the head portion 50, and the second pneumatic line 54 can be in fluid communication with the foot portion 52. As such, the first pneumatic line 16 can be used to inflate the head portion 50 and the second pneumatic line 54 can be used to inflate the foot portion 52. In some embodiments, the head portion 50 and the foot portion 52 can be independently inflatable, such that one portion can be inflated separately from the other. As such, the respective air pressures in each portion can be varied to accommodate the particular needs of the patient. For instance the air pressure can be decreased in one portion of the air cushion on which a patient can place an area of the body affected by sores or other skin conditions, to effectively decrease pressure points on those areas, while the pressure in the other portion can remain or even increase to compensate and give additional support to the patient.

In still other embodiments, the air cushion 14 can also include a middle portion 56 located between the head portion 50 and the foot portion 52. The Apparatus 10 can further include a third pneumatic line 58, the third pneumatic line 58 being in fluid communication with the middle portion 56. The third pneumatic line 58 can then be used to inflate the middle portion 56. In some embodiments, the head portion 50, the foot portion 52, and the middle portion 56 can all be inflated independently of one another to further enhance the adjustability or tailoring of the air cushion 14 to comfortably support a particular patient as previously described.

In some embodiments, as can be seen from FIG. 5, the foam layer 12 can include a groove 60. The first pneumatic line 16 can be positioned in the groove 60. As such, the pressure distribution in the air cushion 14 can be undisturbed by the presence of the first pneumatic line 16 since it is not located between the foam layer 12 and the air cushion 14, but rather is hidden inside the foam layer 12. In those embodiments with a second pneumatic line 54 and a third pneumatic line 58, the first second, and third pneumatic lines 16, 54, and 58 can all be positioned in the groove 60 in the foam layer 12.

The groove 60 in the foam layer 12 can include one or more access cavities 62 that a corresponding pneumatic line can extend out of to connect to a corresponding portion of the air cushion 14. The access cavities 62 allow the pneumatic lines and the hardware for communicating the pneumatic lines with the air cushion 14 to be stored below the top surface of the foam layer 12, again helping preserve a uniform distribution of pressure throughout the air cushion 14.

The groove 60 can extend along a lateral side 64 of the foam layer 12 such that the groove 60 can span across the foam layer 12 so that at least a portion of the groove 60 is beneath each of the head portion 50, the foot portion 52, and the middle portion 56 of the air cushion 14. The groove 60 can terminate in an outlet 66 located in a foot end of the foam layer 12. Each of the first, second, and third pneumatic lines 16, 54, and 58 can extend out of the outlet 66 such that each of the first, second, and third pneumatic lines 16, 54, and 58 can be accessed generally from the same point on the apparatus 10. This can make inflating the air cushion 14 more efficient, because the inflation of all the portions can be done from the same location. The access point for the pneumatic lines can be located at the foot end of the foam layer 12 in order to facilitate inflation of the air cushion 14 in a hospital or medical environment, where typically the foot end of a bed is located in open space and can be easily accessed by an attending nurse or physician. In other embodiments, the pneumatic lines can extend out at different locations of the foam layer 12, which can help keep the pneumatic lines separate and readily identifiable by a nurse or physician.

As can be seen in FIG. 2, in some embodiments the foot end 42 of the removable cover 26 can include a line hole 48. The first pneumatic line 16 can extend out from the removable cover 26 through the line hole 48. As such, the first pneumatic line can be easily accessed even when the removable cover 26 encloses a portion of the first pneumatic line 16, the foam layer 12, and the air cushion 14. Therefore, the air cushion 14 can be inflated via the first pneumatic line 16 without the apparatus 10 having to be disassembled. In those embodiments having a foam layer 12 with a groove 60 and an outlet 66, the line hole 48 in the removable cover 26 can substantially align with the outlet 66 of the foam layer 12 such that the first pneumatic line 16 extends out of the outlet 66 and through the line hole 48.

In those embodiments have multiple pneumatic lines, each of the pneumatic lines can extend out of the line hole 48 such that all of the pneumatic lines can extend from the same general location to make inflating all of the portions of the air cushion 14 more efficient. In other embodiments, the removable cover 26 can include multiple line holes 48 at varying locations on the cover 26, such that each pneumatic line can extend from a different location on the removable cover 26, which can help keep the pneumatic lines separate and readily identifiable by an attending nurse or physician.

Figure 6:
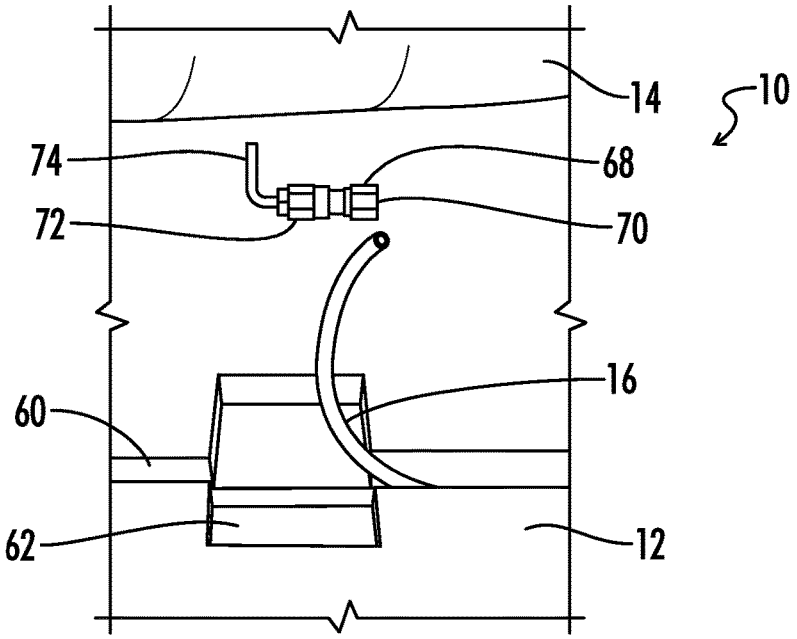
FIG. 6 is a detailed view of the apparatus of FIG. 1 of an exemplary coupling used to connect a pneumatic line to an air cushion.
Figure 7:
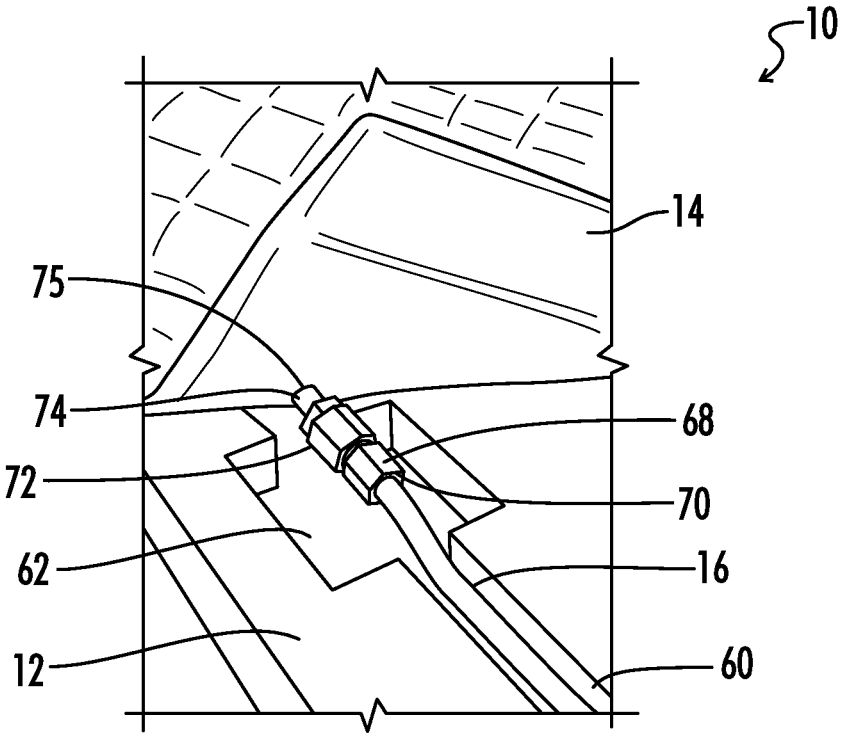
FIG. 7 is a detailed view of the coupling of FIG. 6 being inserted into the air cushion.

A detailed view of an exemplary coupling 68 for fluidly communicating the first pneumatic line 16 with the air cushion 14 is shown in FIG. 6 and FIG. 7. The coupling 68 can be made from brass, copper, steel, or another similar metal which can help prevent air leaking from the coupling 68. The coupling 68 can have a first end 70 configured to receive the first pneumatic line 16. A second end 72 of the coupling 68 can include a nozzle 74 which can be inserted into the air cushion 14. Air can be forced into the air cushion 14 through the nozzle 74.

FIG. 7 shows a detailed view of the first pneumatic line 16 in fluid communication with the air cushion 14. The nozzle 74 is inserted into a corresponding inlet 75 in the air cushion 14. A seal can be formed between the nozzle 74 and the inlet 75 in the air cushion 14 such that air can be prevented from leaking out of the inlet 75. The first pneumatic line 16 can be sealingly connected to the first end 70 of the coupling 68 such that air can also be prevented from leaking out of the connection between the coupling 68 and the first pneumatic line 16. Once the pneumatic line 16 is fluidly communicated with the air cushion 14, the pneumatic line 16 can be positioned in the groove 60 and the coupling 68 and nozzle 74 can be positioned in the access cavity 62 to help prevent the pneumatic line 16 and the coupling 68 from affecting the distribution of pressure within the air cushion 14. For those embodiments with multiple air cushion 14 portions and multiple pneumatic lines, a similar coupling 68 and nozzle 74 can be utilized for each pneumatic line being fluidly communicated with the air cushion 14.

Figure 8:
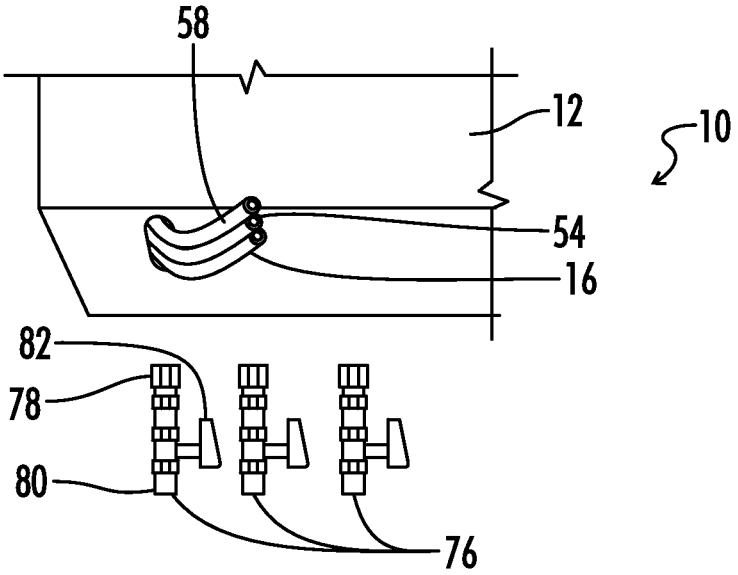
FIG. 8 is a detailed view of an exemplary valve which can be connected to the pneumatic line to control the flow of air into the air cushion.

A detailed view of an exemplary valve 76 used to control the flow of air in and out of the air cushion 14 via the first pneumatic line 16 is shown in FIG. 8. The valve 76 can be fluidly communicated with the pneumatic line 16 at an end opposite the coupling 68. The valve 76 can be configured to alternate between an open position and a closed position. The valve 76 can have a first port 78 configured to receive the pneumatic line 16, and a second port 80 which can be connected to an airline or other air flow device. The valve 76 can include a switch 82 which can be operable to alternate the valve between an open and closed position. When the valve 76 is in an open position, the valve can allow air to pass through the pneumatic line 16 such that the air cushion 14 can be inflated or deflated. When the valve 76 is in the closed position, the valve 76 can prevent the flow of air through the pneumatic line 16 which can keep the air cushion 14 inflated to a desired pressure. In those embodiments with multiple pneumatic lines, each pneumatic line can be fitted with a similar valve such that flow of air through each pneumatic line can effectively be controlled. The valves 76 can be made from brass, copper, or another similar metal which can help prevent leaks during use of the apparatus 10.

Figure 9:
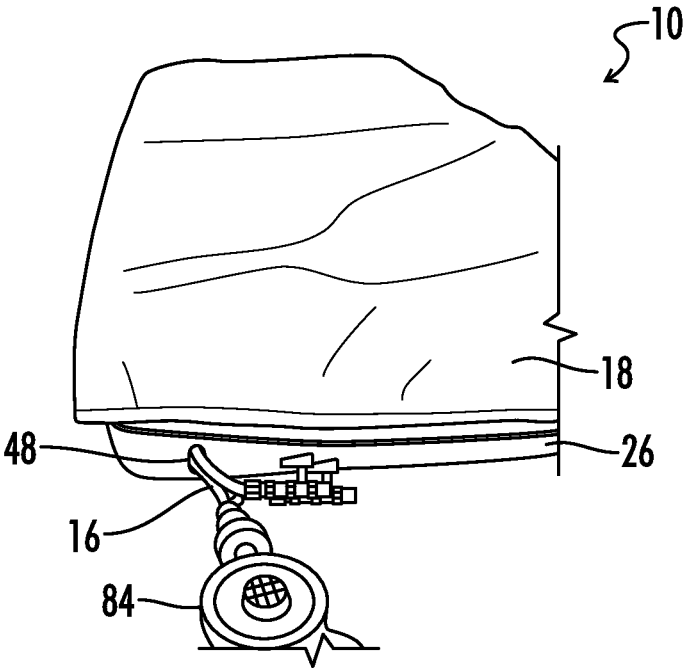
FIG. 9 is a detailed view of an exemplary pump that can be connected to the pneumatic line to inflate the air cushion.

A detailed view of a pump 84 which can be utilized to inflate the air cushion 14 is shown in FIG. 9. While the air cushion 14 can be inflated by any suitable source of air which can be connected to the pneumatic line 16, one such source of air can be a pump 84. In some embodiments, the pump 84 can be a handheld pump that does not require the pump 84 to run off of electric power. As such, the apparatus 10 can be utilized when electric power is not available, such as in emergency or disaster situations. The pump 84 can be battery powered or can be manually operated. The pump 84 can be alternating attached to different pneumatic lines in order to inflate different portions of the air cushion 14 separately.

While present invention has been described primarily in terms of medical applications, the inventive concepts of the present invention can be used for many applications where it may be beneficial to relieve pressure on a user's body. One such use may be for those users who have trouble sleeping in traditional beds because the pressure points created by traditional beds can cause back pain or other joint pain. The inventive concepts of the present invention can help contour a user during sleep to relieve or eliminate such pain or generally promote proper alignment of a user during sleep.

Thus, although there have been described particular embodiments of the present invention of a new and useful Air Fluidized Mattress it is not intended that such references be construed as limitations upon the scope of this invention except as set forth in the following claims.

What is claimed is:

1. A mattress apparatus comprising:
a foam layer;
an inflatable air cushion superposed with the foam layer;
a first pneumatic line in fluid communication with the air cushion;
a metal pneumatic coupling fluidly communicating and providing a seal between the first pneumatic line and the inflatable air cushion;
a manually operated metal valve in fluid communication with the first pneumatic line, the metal valve movable between an open position and a closed position;
a manual pump removably coupled to the first pneumatic line; and
a non-shearing layer covering at least a portion of the air cushion.

2. The apparatus of claim 1, wherein:
the foam layer further comprises a groove; and
the first pneumatic line is positioned in the groove.

3. The apparatus of claim 1, further comprising a second pneumatic line and a third pneumatic line, wherein:
the air cushion further comprises a head portion, a foot portion, and a middle portion;
the first pneumatic line is in fluid communication with the head portion;
the second pneumatic line is in fluid communication with the foot portion; and
the third pneumatic line is in fluid communication with the middle portion.

4. The apparatus of claim 3, wherein the head portion, the middle portion, and the foot portion are each independently inflatable.

5. The apparatus of claim 1, wherein the foam layer comprises viscoelastic polyurethane foam.

6. The apparatus of claim 1, further comprising:
a removable cover at least partially enclosing the foam layer, the air cushion, the pneumatic line, and the non-shearing layer; and
an air passage defined through the removable cover.

7. The apparatus of claim 6, wherein:
the removable cover includes:
a first fastener on a first side of the removable cover;
a second fastener on a second side of the removable cover;
a foot end; and
a head end;
the first and second fasteners define a first opening in the foot end;
the first and second fasteners define a second opening in the head end; and
the first and second openings define the air passage through the removable cover.

8. The apparatus of claim 6, wherein the removable cover includes a foot end having a line hole, the first pneumatic line extending out of the removable cover through the line hole.

9. The apparatus of claim 6, wherein:
The removable cover further comprises a top portion and a bottom portion;
the top portion is configured to prevent fluids from passing through it; and
the bottom portion includes a gripping surface.

10. The apparatus of claim 1, wherein the air cushion further comprises a plurality of air cells.

11. The apparatus of claim 1, wherein the pump is configured to selectively force a supply of air through the first pneumatic line into the air cushion.

12. The apparatus of claim 1, wherein:
the valve in the open position allows air to pass through the first pneumatic line; and
the valve in the closed position prevents air from passing through the first pneumatic line.

13. The apparatus of claim 1, wherein the non-shearing layer comprises a low friction nylon material.

14. A mattress apparatus comprising:
a foam layer having a lateral side, a foot end, and a head end;
an inflatable air cushion positioned on top of the foam layer, the air cushion having a head portion and a foot portion;
a first pneumatic line in fluid communication with the head portion of the air cushion;
a second pneumatic line in fluid communication with the foot portion of the air cushion;
a groove defined in the foam layer, the groove extending along a lateral side of the foam layer from the head end of the foam layer to the foot end of the foam layer and terminating in an outlet located in the foot end of the foam layer, the first and second pneumatic lines positioned in the groove and extending out of the foot end of the foam layer; and a low friction layer positioned on top of the air cushion, the low friction layer covering at least a portion of the air cushion.

15. The apparatus of claim 14, further comprising a third pneumatic line, wherein:

the air cushion further comprises a middle portion positioned between the head portion and the foot portion; and the third pneumatic line is in fluid communication with the middle portion of the air cushion.

16. The apparatus of claim 14, wherein the head portion and the foot portion are independently inflatable.

17. The apparatus of claim 14, further comprising:

a removable cover at least partially enclosing the foam layer, the air cushion, the first pneumatic line, and the second pneumatic line;

a line hole defined in the removable cover, the line hole aligned with the outlet of the groove in the foam layer; and an air passage defined through the removable cover.

* * * * *